United States Patent [19]

Okuda et al.

[11] Patent Number: 4,641,830

[45] Date of Patent: Feb. 10, 1987

[54] PRINTER PAPER FEEDING APPARATUS

[75] Inventors: Kazuhiro Okuda; Makoto Tanaka; Wataru Kuramitsu, all of Chofu, Japan

[73] Assignee: Tokyo Juki Industrial Co., Ltd., Tokyo, Japan

[21] Appl. No.: 797,948

[22] Filed: Nov. 14, 1985

[30] Foreign Application Priority Data

Nov. 15, 1984 [JP] Japan ..... 59-173602[U]

[51] Int. Cl.[4] ..... B65H 5/06

[52] U.S. Cl. ..... 271/274; 400/600.2; 400/637.1; 400/639.1

[58] Field of Search ..... 271/273, 274; 400/595, 400/600.2, 600.3, 600.4, 636, 637, 637.1, 639.1, 639.2, 645.4

[56] References Cited

U.S. PATENT DOCUMENTS

| | | | |
|---|---|---|---|
| 2,713,932 | 7/1955 | Letterman | 400/637.1 X |
| 4,341,477 | 7/1982 | Theilen | 400/639.1 X |
| 4,522,520 | 6/1985 | Takenoya | 271/274 X |

*Primary Examiner*—Richard A. Schacher

*Attorney, Agent, or Firm*—Morgan & Finnegan

[57] ABSTRACT

A printer paper feeding apparatus providing cams at the central portion of a paper release lever around a platen shaft. A first cam is adapted to release paper bail rollers by rotation of the paper release lever. A second cam is adapted to contact and release presser rollers against a platen by rotation of the paper release lever.

2 Claims, 3 Drawing Figures

PRINTER PAPER FEEDING APPARATUS

BACKGROUND OF THE INVENTION

The invention relates to a paper feeding apparatus for a printer.

The platen of a printer conventionally provides a presser roller which presses the paper against the platen and a paper bail roller which folds back the paper. The rollers are operated relative to each rotation of the platen and are designed to engage or disengage individually with the platen.

Japanese Utility Model No. 58-151059 discloses a printer paper feed apparatus where, as the presser roller is engaged or disengaged with the platen, the paper bail roller also engages or disengages with the platen in cooperation with the presser roller and thereby eases the paper feeding operation. However, to make the presser roller and the paper bail roller operate together, both rollers must move through a linkage mechanism and, to connect the linkage system, the whole mechanism must be redesigned.

SUMMARY OF THE INVENTION

With the foregoing in mind, it is an object of the invention to provide a new and improved apparatus for feeding paper in a printer which operates the presser roller and the paper bail roller in cooperation with each other by employing cams and where the apparatus is easily attached to an existing printer.

Briefly described, the apparatus comprises a platen, a lever, a paper bail roller, a presser roller, and two cams. The paper bail roller is urged into contact with the platen by gravity and the presser roller is urged into contact with the platen by a spring. The first cam is adapted to cooperate with the arm supporting the paper bail roller to allow locking it in the released position. The second cam is adapted to cooperate with the arm supporting the presser roller to release it from the platen.

Paper is loaded into the platen by releasing the paper bail roller from the platen and rotating the lever clockwise thereby bringing the presser roller into contact with the platen. The paper is then inserted and rolled into the platen. Paper is removed from the platen by moving the lever counter-clockwise thereby releasing the paper bail roller and the presser roller from the platen and leaving the lever in the locked position and allowing removal of the paper.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DESCRIPTION OF THE PREFERRED EMBODIMENT

Figure 1:
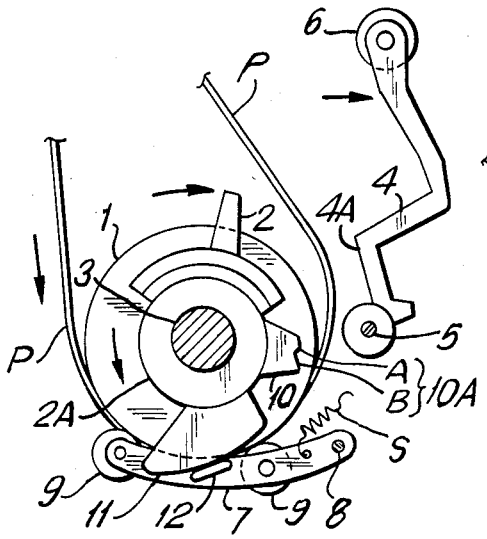
FIG. 1 is a side view of the preferred embodiment of the invention wherein the paper bail arm is released from the platen and the presser roller is in contact with the platen.
Figure 2:
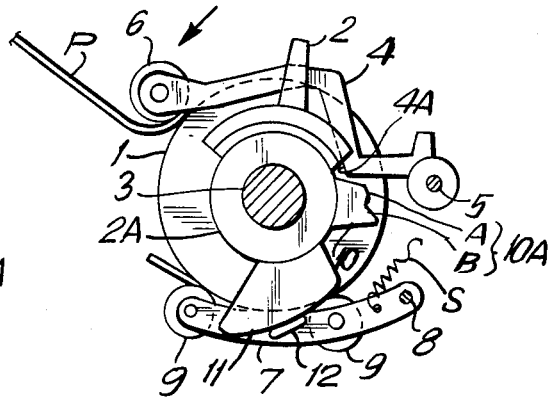
FIG. 2 is a side view of the preferred embodiment of the invention wherein the paper is completely loaded over the platen.

Referring to FIGS. 1 and 2, platen 1 is rotatably supported by the machine frame (not shown) and lever 2 is rotatably supported at its center portion 2A at shaft 3 which is fixed to the machine frame. Paper bail arm 4 has one end rotatably supported by shaft 5, which is fixed to the machine frame, and the other end of paper bail arm 4 provides paper bail roller 6 which is normally urged into contact platen 1 by gravity.

Presser arm 7 has one end rotatably supported at shaft 8, which is fixed to the machine frame at the lower side of the platen, and the other end of presser arm 7 rotatably supports presser roller 9. Presser arm 7 is urged into contact with the surface of platen 1 through presser roller 9 by spring S which is stretched between the machine frame and the presser arm 7.

A first cam 10 is attached at the center portion 2A of lever 2 and forms a first cam portion 10A at its end. The cam portion 10A comprises a sloped portion "A" and another sloped portion "B", and when the first cam engages elbow 4A, due to the external force applied on sloped portions "A", "B", lever 2 is locked by paper bail arm 4.

A second cam 11 is provided at the center portion 2A of lever 2 and the distance from shaft 3 to the edge of cam 11 is configured to be gradually increasing in the clockwise direction. Stopper 12 is provided at presser arm 7 and is facing against the second cam 11.

In operation, paper bail arm 4 is rotated clockwise and is released from platen 1. Lever 2 is rotated clockwise and presser roller 9 contacts platen 1. Paper P is inserted between platen 1 and presser roller 9 and platen 1 is manually rotated counter clockwise. Paper P is rolled in platen 1 and is transferred to paper bail roller 6. As shown in FIG. 2, if the paper bail arm 4 is rotated counter-clockwise, the paper P is completely loaded over platen 1, and the paper is set. The printer is then ready for printing.

Figure 3:
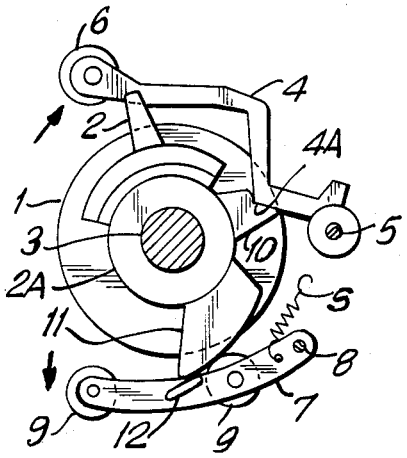
FIG. 3 is a side view of the preferred embodiment of the invention wherein the paper bail roller and the presser roller are released from the platen.

Referring to FIG. 3, when finished printing, the operator rotates lever 2 counter clockwise to release the printed paper from the platen 1, the second cam rotates counter clockwise and presses down stopper 12. Thus, presser arm 7 is rotated counter-clockwise, about shaft 8 and consequently presser roller 9 and paper bail roller 6 release from the platen.

The first cam 10 rotates counter-clockwise and engages with elbow 4A of paper bail arm 4, the sloped portion "A" of cam 10 lifting up the paper bail arm 4, and the paper bail arm 4 rotates clockwise keeping shaft 5 as the center. Thus, paper bail arm 4 releases from contact with platen 1. When paper bail arm 4 is rotated to a certain degree, elbow 4A is positioned betwen sloped portion "A" and sloped portion "B" thereby leaving lever 2 in the locked position by paper bail arm 4.

As described above, the operation of lever 2 causes both the paper bail roller 6 and the presser roller 9 to release from the platen 1 simultaneously. Thus, the operator can take papers out of the platen more easily than with conventional printers.

It is understood that the above-described embodiment of the invention is illustrative only and that modifications thereof may be made without departing from the scope and spirit of the invention.

What is claimed is:

1. A paper feeding apparatus for a printer comprising:

(a) a machine frame;

(b) a platen rotatably supported by said machine frame;

(c) a lever rotatably supported by said machine frame;

(d) a paper bail roller adapted to contact said platen;

(e) a paper bail arm, one end of said paper bail arm rotatably supported by said machine frame and the other end rotatably supporting said paper bail roller;

(f) a presser roller adapted to contact said platen;

(g) a presser arm, one end of said presser arm rotatably supported by said machine frame and the other end rotatably supporting said presser roller;

(h) a first cam fixedly attached to the center portion of said lever and adapted to release said paper bail roller from contact with said platen on manipulation of said lever; and (i) a second cam fixedly attached to the center portion of said lever and adapted to release said presser roller from contact with said platen on manipulation of said lever.

2. A paper feeding apparatus for a printer as recited in claim 1, wherein said first cam provides cam surfaces adapted to cooperate with said paper bail arm providing means for locking the apparatus in the released position.

* * * * *